United States Patent [19]

Apprille, Jr. et al.

[11] Patent Number: 4,624,051

[45] Date of Patent: Nov. 25, 1986

[54] SHAVING UNIT

[75] Inventors: Domenic V. Apprille, Jr., Arlington; Ralph J. Chesnauskas, Peabody; Chester F. Jacobson, Southboro; Robert A. Trotta, Pembroke, all of Mass.

[73] Assignee: The Gillette Company, Boston, Mass.

[21] Appl. No.: 679,258

[22] Filed: Dec. 7, 1984

[51] Int. Cl.[4] ..... B26B 21/00; B26B 19/40; B26B 21/14

[52] U.S. Cl. ..... 30/50; 30/32; 30/41; 30/84

[58] Field of Search ..... 30/32, 41, 50, 83, 84, 30/85; 83/14

[56] References Cited

U.S. PATENT DOCUMENTS

| | | | |
|---|---|---|---|
| 2,183,554 | 12/1939 | Evans | 30/41 |
| 2,292,418 | 8/1942 | Weatherbee . | |
| 2,292,419 | 8/1942 | Weatherbee . | |
| 2,365,444 | 5/1945 | Schwartz . | |
| 3,758,161 | 10/1973 | Miller . | |
| 3,811,349 | 5/1974 | Jennings | 83/14 |
| 3,956,951 | 5/1976 | Jennings, Sr. | 83/14 |
| 4,047,296 | 9/1977 | Ishida et al. | 30/41 |
| 4,170,821 | 10/1979 | Booth . | |

FOREIGN PATENT DOCUMENTS

| | | |
|---|---|---|
| 2024082 | 1/1980 | United Kingdom . |

*Primary Examiner*—Paul A. Bell
*Assistant Examiner*—Paul M. Heyrana Sr.

[57] ABSTRACT

A shaving unit comprises at least one blade and blade support structure that has external guard and cap surfaces for engaging the user's skin respectively ahead and rearwardly of the blade edge or edges. A shaving aid member of extrusion-oriented polymeric material that includes an effective amount of a water-leachable shaving aid composition is permanently and substantially immovably affixed to the support structure with an upper surface protruding above one of the external skin engaging surfaces adjacent the cutting edge of the blade.

27 Claims, 14 Drawing Figures

FIG. 1
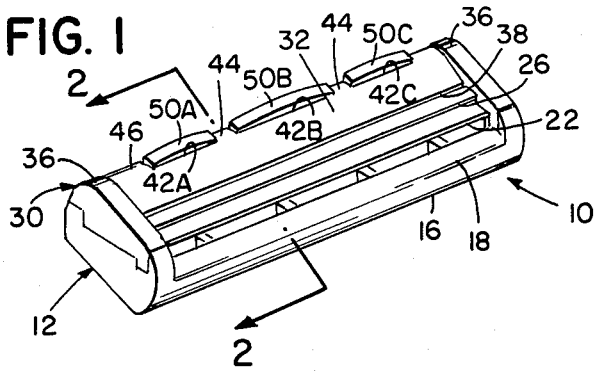
FIG. 6
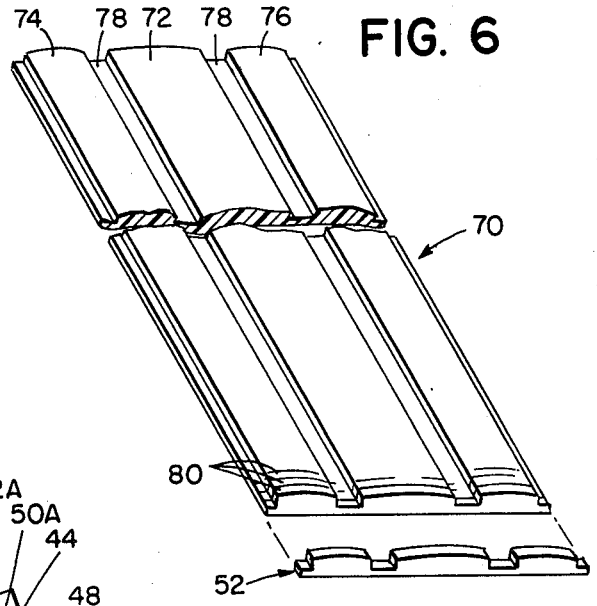
FIG. 2
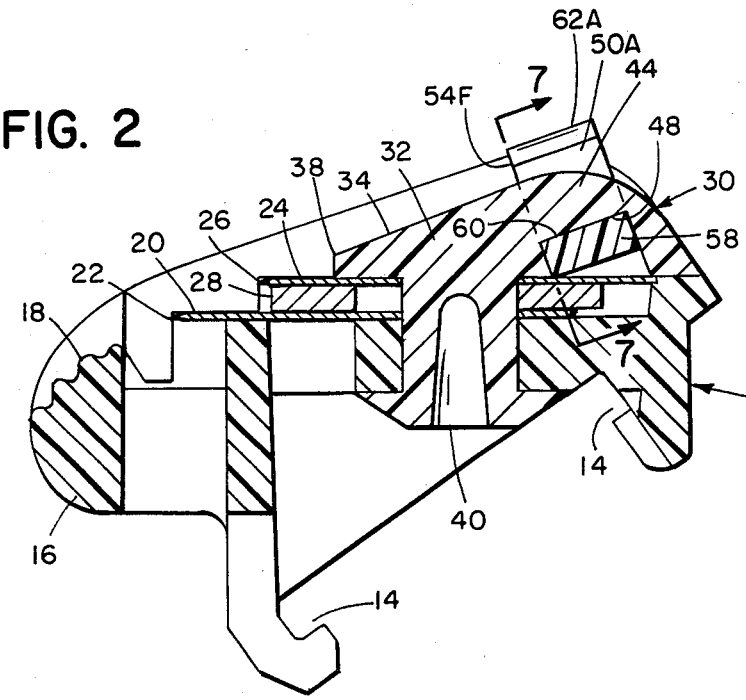
FIG. 3
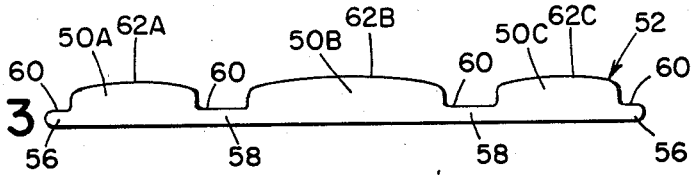
FIG. 5
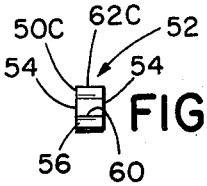
FIG. 4
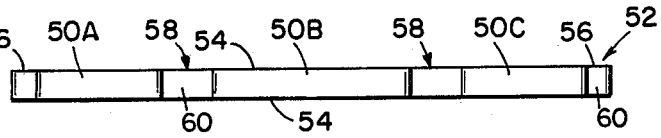
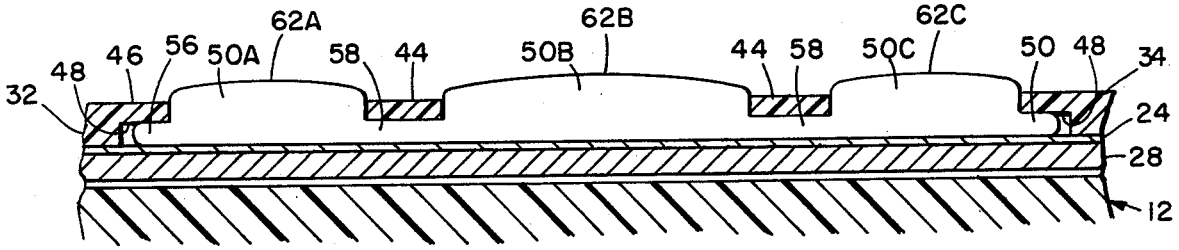
FIG. 7

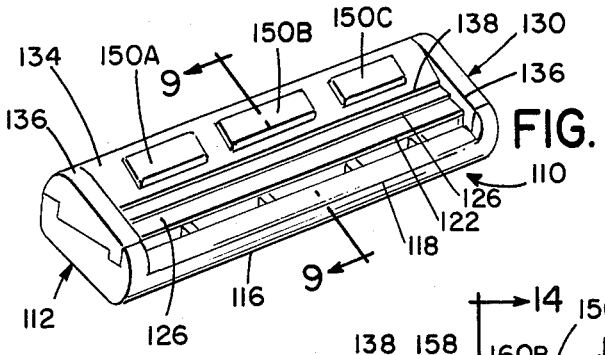
FIG. 8
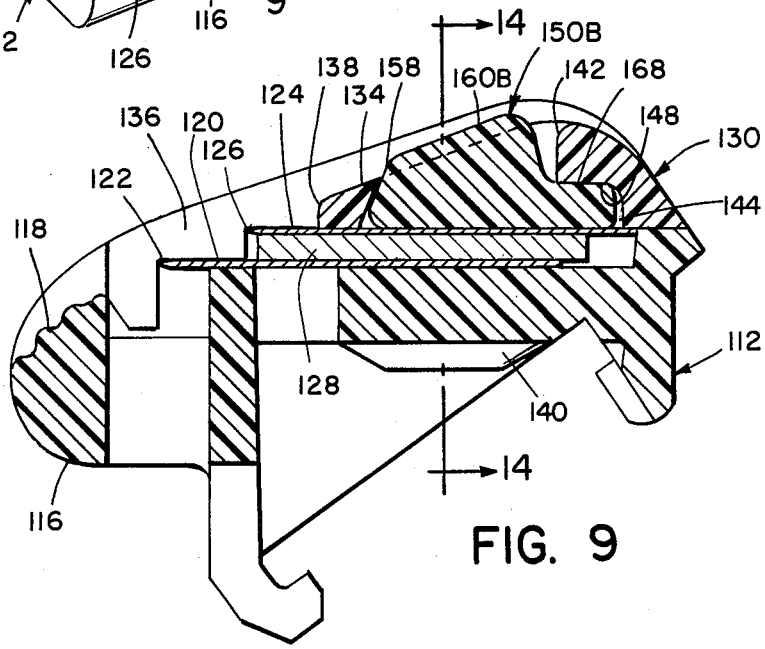
FIG. 9
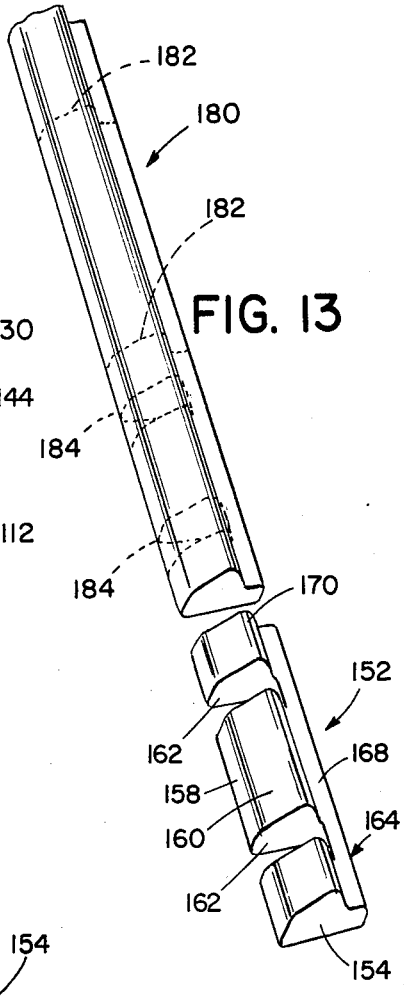
FIG. 13
FIG. 10
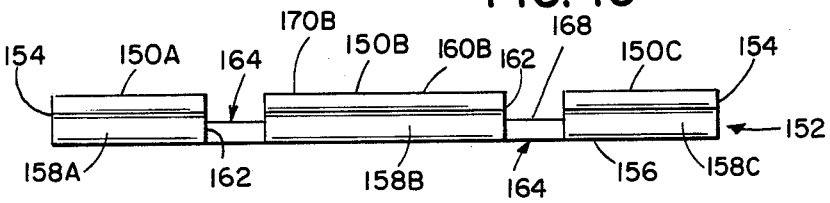
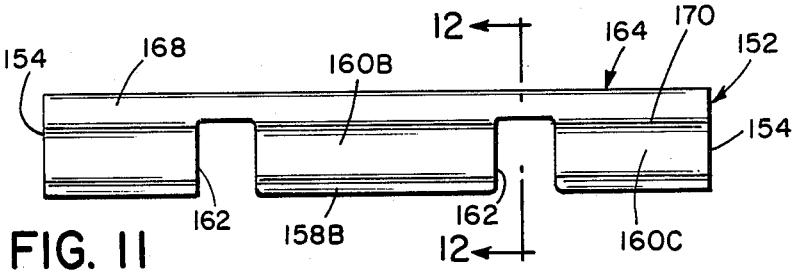
FIG. 11
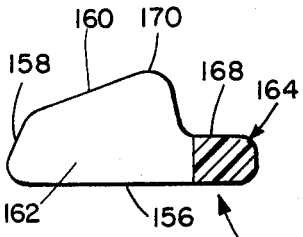
FIG. 12
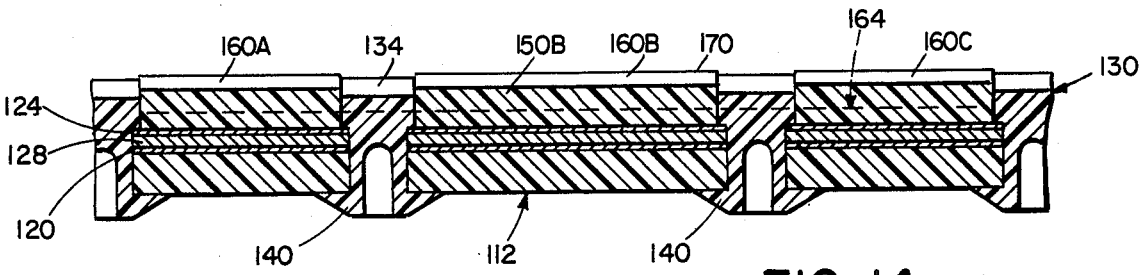
FIG. 14

SHAVING UNIT

This invention relates to shaving systems, and more particularly to shaving systems of the wet shave type.

In shaving systems of the wet shave type, factors such as frictional drag of the razor across the skin, force needed to sever hairs, and irritation or pre-existing skin damage can create a degree of shaving discomfort. Proposals have been made to reduce such discomfort by incorporating water-leachable shaving aid material such as polyethylene oxide into the razor as, for example, by depositing shaving aid material in a razor recess, by incorporating shaving aid material directly into one or more of the molded polymeric components of the razor, by adhesively securing shaving aid material to the razor, and by use of a snap-in type unit that is formed from shaving aid material by injection molding. None of these arrangements have been entirely satisfactory. The water leachable shaving aid material must be positively secured for effective dispensing throughout the useful shaving life of the razor without distortion or degradation of the razor's shaving geometry, either initially, or during use, due for example to attachment impairment after an initial portion of the shaving aid material has been leached out during razor use.

In accordance with one aspect of the invention, there is provided a shaving unit that comprises at least one blade and blade support structure that has external guard and cap surfaces for engaging the user's skin respectively ahead and rearwardly of the blade edge or edges. The shaving unit may be of the disposable cartridge type adapted for coupling to and uncoupling from a razor handle or may be integral with a handle so that the complete razor is discarded as a unit when the blade or blades become dulled. The front and rear skin engaging surfaces cooperate with the blade edge (or edges) to define the shaving geometry. A through aperture formed in one of those surfaces extends from the external skin engaging surface inwardly to an interior surface. A shaving aid member that includes an effective amount of a water-leachable shaving aid composition has a body portion of shape corresponding to that of the aperture, an external upper surface and a laterally outwardly extending tab portion at the base of the body portion. The shaving aid member is disposed in the aperture with its upper surface protruding above the skin engaging surface and the tab portion at the base mechanically captivated to firmly seat the tab portion against the interior support structure surface.

In accordance with another aspect of the invention, there is provided a shaving unit that comprises at least one blade and blade support structure that has external guard and cap surfaces for engaging the user's skin respectively ahead and rearwardly of the blade edge or edges. A shaving aid member of extrusion oriented polymeric material that includes an effective amount of a water-leachable shaving aid composition is permanently and substantially immovably affixed to the support structure with an upper surface protruding above one of the external skin engaging surfaces adjacent the cutting edge of the blade.

In preferred embodiments, the shaving aid member is a polymer blend that contains at least one water soluble polymeric shaving aid material and at least one water insoluble polymeric material, the water soluble material being such that it is leached out of the member on contact with water. The nature and relative proportions of the water soluble and water insoluble polymeric materials in the polymer blend should be such that the member has adequate mechanical strength, both as initially produced and after a significant amount of the water soluble material has been leached out, the quantity of the water soluble material being sufficient to provide effective shaving assistance, such as lubrication, for the entire expected life of the blade or blades. Comfortable and effective shaving can be obtained simply by wetting the shaving area with water prior to shaving, the water present on the shaving area leaching out a proportion of the water soluble material for delivery to the skin surface. Suitable water soluble materials include, for example, polyethylene oxide, polyvinyl pyrrolidone, polyacrylamides, hydroxypropyl cellulose, polyvinyl imidazonline and polyhydroxyethylmethacrylate. Suitable water insoluble materials include, for example, polyethylene, polypropylene, polystyrene and polyacetal. The proportions may be varied but the blend preferably includes at least 50% of the water soluble shaving aid material. In a particular embodiment, the captivated member is composed of a blend of about 20% water insoluble polystyrene and 80% water soluble polyethylene oxide (with additives such as color dyes and bacteriacides in minor amounts).

In preferred embodiments, the captivated member is a slice portion of an extruded elongated element, the slice portion having opposed planar edge surfaces such that its body portion is of uniform width or length and provides an upper surface area in the range of 20–70 square millimeters with a tab portion that is clamped between cap and blade surfaces. In particular embodiments, a polymer blend formed of a mixture of about 80% by weight polyethylene oxide and about 20% by weight of polystyrene—the polyethylene oxide of the resulting mixture having a molecular weight of about 3.5 million—is extruded to form an elongated convoluted element. Shaving aid members are then separated from the extruded element as transverse slices, in one embodiment the shaving aid member being a transverse slice from a convoluted sheet and having a tab portion at either end and two intermediate tab portions and in another embodiment the shaving aid member being sliced as a longitudinal length from a convoluted rod and having a tab portion extending along its length and notch portions to define three spaced body portions. The shaving unit in those embodiments has a cap member with three transversely spaced rectangular apertures in which corresponding body portions of the shaving aid member are disposed so that their upper surfaces are disposed at least about 0.1 millimeter above the skin engaging surface. The rear portion of a razor blade is clamped against the tab portions to firmly seat them in mating engagement with the interior aperture surfaces. In use, the polyethylene oxide constituent of the captivated member, when exposed to water, exudes a lubricating film which enhances shaving effectiveness of the razor. For reasons that are not clearly understood, the polyethylene oxide is dispersed at a more favorable rate from the extruded slice member than from a member of the same shape that has been formed from the same composition by injection molding.

Other features and advantages will be seen as the following description of particular embodiments progresses, in conjunction with the drawings, in which:

FIG. 1 is a perspective view of a razor blade unit in accordance with the invention;

FIG. 2 is a sectional view taken along the line 2—2 of FIG. 1;

FIG. 3 is a side elevational view of the shaving aid member incorporated in the blade unit of FIG. 1;

FIG. 4 is a top view of the shaving aid member of FIG. 3;

FIG. 5 is an end view of the shaving aid member of FIG. 3;

FIG. 6 is a perspective view of a portion of an extruded strip from which the shaving aid member of FIGS. 3-5 is formed;

FIG. 7 is a sectional view taken along the line 7—7 of FIG. 2;

FIG. 8 is a perspective view of another razor blade unit in accordance with the invention;

FIG. 9 is a sectional view taken along the line 9—9 of FIG. 8;

FIG. 10 is a front view of the shaving aid member incorporated in the blade unit of FIG. 8;

FIG. 11 is a side elevational view of the shaving aid member of FIG. 10;

FIG. 12 is a sectional view of the shaving aid member taken along the line 12—12 of FIG. 11;

FIG. 13 is a perspective view of a portion of an extruded strip from which the shaving aid member of FIGS. 10-12 is severed; and FIG. 14 is a sectional view taken along the line 14—14 of FIG. 9.

DESCRIPTION OF PARTICULAR EMBODIMENTS

The shaving unit 10 shown in FIGS. 1 and 2 includes a base or platform member 12 molded of high impact polystyrene that includes integral coupling groove structure 14 for attachment to a razor handle and guard structure 16 that defines a transversely extending forward skin engaging surface 18. On the upper surface of platform 12 are disposed steel leading blade 20 having a sharpened edge 22, steel following blade 24 having sharpened edge 26, and aluminum spacer member 28 that maintains blades 20 and 24 in spaced relation. Cap member 30 is molded of high impact polystyrene and has body portion 32 that defines skin engaging surface 34 that extends transversely between forwardly projecting end walls 36 and has a front edge 38 that is disposed rearwardly of blade edge 26. Integral rivet portions 40 extend downwardly from the transversely extending body portion 32 and pas through holes in blades 20 and 24 and spacer 28 and platform 12 to secure cap 30, blades 20, 24 and spacer 28 on platform 12.

Formed in transversely extending body portion 32 of cap 30 are a series of through apertures 42A, 42B and 42C, located about three millimeters rearwardly of cap surface 38. Each aperture 42 has a width of about 1.5 millimeters, apertures 42A and 42C each having a length of about two-thirds centimeter and aperture 42B having a length of about one centimeter. Webs 44 between apertures 42 and end sections 46 are about 0.8 millimeter thick and define planar internal surfaces 48 (FIG. 7).

Disposed in and projecting upwardly through apertures 42 are body portions 50A, 50B, 50C of shaving aid member 52, further details of which can be seen with reference to FIGS. 3-5. Member 52 has parallel planar sides 54 that are spaced about 1.4 millimeters apart, an overall length of about three centimeters and is about 2.3 millimeters in overall height. Body sections 50A and 50C each have a length of about five-eighths centimeter and central body section 50B has a length of about one centimeter. At either end of member 52 are tab portions 56 that have a thickness of about three-fourths millimeter and a length of about one-quarter centimeter, while intermediate tab sections 58 are of similar thickness and each has a length of about one-quarter centimeter. The upper surface 60 of each tab 56, 58 is about 1.5 millimeters below the crest of the convex upper outer surface 62 of each body portion 50, surfaces 62A and 62C each having an area of about ten square millimeters while surface 62B of the center body portion 50B has an area of about fifteen square millimeters.

Member 52 is formed of a blend of 80% by weight of a water soluble polymer (specifically a mixture of 60 weight percent Polyox Coagulent polyethylene oxide—5,000,000 molecular weight—and 40 weight percent Polyox WSR N-750 polyethylene oxide—300,000 molecular weight) and 20% by weight of water insoluble polystyrene—the polyethylene oxide of the ultimate blend having a molecular weight of about 3.5 million. The blend includes color dye and bacteriacide additives in minor amounts. This blend is extruded through a Haake Extruder (nineteen millimeter diameter screw) (barrel pressure of about 3600 psi and temperature of about 150° C. and extruder die pressure of about 1500 psi and temperature of about 150° C. with low tension on the extrudate) to form the convoluted sheet 70 shown in FIG. 6 that has center raised section 72 that is separated from raised side sections 74, 76 by valley sections 78. The polyethylene oxide of the extruded polymer blend sheet material has a molecular weight of about one million. Members 52 are sliced from extruded sheet 70 as indicated by the transverse lines 80 in FIG. 6. Immersion of member 52 in water causes gradual release of the polyethylene oxide, and that loss of weight of member 52 due to release of polyethylene oxide being a generally linear function of time—member 52 having about six percent weight loss after immersion in 20°-23° C. water for thirty minutes and about thirty five percent weight loss after immersion in 20°-23° C. water for two hundred ten minutes (the weight loss in each instance being measured after the member 52 has been dried in air at 50° C. for twentyfour hours).

The amounts of the polymers in the composite is not narrowly critical and as indicated above, minor amounts of additives such as colorants, dyes, stabilizers, bacteriacides and the like can be included in the polymer mixture. However, it is preferred to use about ten to forty percent by weight of the water insoluble polymer in the formed extruded sheet. Some water soluble polymers tend to become excessively slippery due to the absorption of water and lose their rigidity while other water soluble polymers are too rigid in the melted state to provide a satisfactory extrusion material alone. Extrusion temperatures and pressures will vary with the particular polymers used according t the expertise of those skilled in the art.

Shaving unit 10 may be assembled in manner similar to the blade units shown and described in U.S. Pat. No. 3,786,563. In assembly, the body portions 50 of member 52 are inserted through apertures 42 of cap 30 so that surfaces 62 protrude about 0.7 millimeter above skin engaging surface 34. The front surfaces of portions 50 are located about three millimeters rearwardly of the forward edge 38 of skin engaging cap surface 34. Tabs 56 and 58 are seated on and urged by the upper blade 24 so that their tab surfaces 60 are in firm mechanical engagement with aperture internal surfaces 48 as indicated in FIG. 7, thus firmly captivating the protruding body portions 50.

Another shaving unit 110 is shown in FIGS. 8 and 9 and includes a base or platform member 112 and cap member 130, each molded of high impact polystyrene. Clamped between platform 112 and cap 130 are steel leading blade 120 having a sharpened edge 122, steel following blade 124 having sharpened edge 126, aluminum spacer member 128 that maintains blades 120 and 124 in spaced relation, and shaving aid member 152. Platform 112 includes guard structure 116 that defines a transversely extending forward skin engaging surface 118 and cap member 130 defines skin engaging surface 134 that extends transversely between forwardly projecting end walls 136 and has a front edge 138 that is disposed rearwardly of blade edge 126.

Formed in transversely extending body portion 132 of cap 130 are a series of through apertures 142A, 142B and 142C, the forward edges of which are located about one millimeter rearwardly of cap surface 138. Each aperture 142 has a width of about 2.5 millimeters, apertures 142A and 142C each having a length of about two-thirds centimeter and aperture 142B having a length of about one centimeter. Also formed in transversely extending body portion 132 of cap 130 rearwardly of apertures 142 is transversely extending channel 144 that defines planar internal surface 148 (FIG. 9).

Disposed in and projecting upwardly through apertures 142 are body portions 150A, 150B, 150C of shaving aid member 152, further details of which can be seen with reference to FIGS. 10–12. Member 152 has a length of about three centimeters, an overall width of about four millimeters and an overall height of about two millimeters. Body sections 150A and 150C each have a length of about five-eighths centimeter and central body section 150B has a length of about one centimeter. Member 152 has parallel planar end surfaces 154, planar base surface 156, front surface 158 that is inclined at an angle of about sixty degrees, upper surface 160 that is inclined at an angle of about twenty degrees to base surface 156, notches that have parallel wall surfaces 162 and that extend through body portions 150 to transverse tab portion 164 that extends the full length of member 152 along its rear edge, tab portion 164 having a width of about one millimeter and a thickness of about three-fourths millimeter. The upper surface 168 of tab 164 is about one millimeter below the crest 170 of upper surface 160 of each body portion 150, surfaces 160A and 160C each having an area of about fifteen square millimeters while surface 160B of the center body portion 150B has an area of about twenty-five square millimeters.

A blend of a water soluble polymer and water insoluble polymer similar to the blend used to form member 52 is extruded in similar manner to form the convoluted rod 180 shown in FIG. 13. Members 152 are cut from extruded rod 180 as indicated by the transverse lines 182 in FIG. 13 and the spaced notch walls 162 of body portions 150 are formed in a 'dinking' operation as indicated by the dotted lines 184 in FIG. 13.

In assembly, the body portions 150 of member 152 are inserted through apertures 142 of cap 130 so that surfaces 160 are parallel to and protrude about 0.7 millimeter above skin engaging surface 134 and front surfaces 158 of portions 150 are located about one millimeter rearwardly of the forward edge 138 of surface 134. The integral rivet portions 140 extend downwardly from the transversely extending body portion 132 through the notches 162, pass through holes in blades 120 and 124 and spacer 128 and platform 112 and are cold-headed to secure cap 130, blades 122, 124 and spacer 128 on platform 112. Shaving unit 110 may be assembled in manner similar to the blade units shown and described in U.S. Pat. No. 3,786,563. The base surface 156 of member 152 is seated on the upper blade 124 and tab 164 is urged upwardly by that blade so that tab surface 168 is in firm mechanical engagement with internal surface 148 of channel 144 as indicated in FIG. 9, thus firmly captivating the protruding body portions 150.

Shaving units 10 and 110 are used in conventional manner (typically in conjunction with a shaving cream or gel) with the polyethylene oxide lubricant being dispensed or extracted from member 52 (152) by water to form a lubricating film. With each stroke of the razor, the lubricant material is immediately applied to the skin and thus provides a film of shaving aid material that is continually renewed during shaving operations over the useful life of shaving unit 10 (110). Member 52 (152) swells so that body portions 50 (150) tend to fill apertures 42 (142) and remains securely captivated by the firm interengagement of cap surfaces 48 (148) and tab surfaces 60 (168).

While particular embodiments of the invention have been shown and described, various modifications will be apparent to those skilled in the art and therefore it is not intended that the invention be limited to the disclosed embodiment or to details thereof and departures may be made therefrom within the spirit and scope of the invention.

What is claimed is:

1. A razor having a razor blade and support structure that define external skin engaging surfaces in front of and to the rear of the cutting edge of said blade, a through aperture in one of said skin engaging surfaces that has a seat surface adjacent an internal edge of said aperture, a shaving aid member that includes an effective amount of a water-leachable shaving aid composition that has a body portion of shape corresponding to said aperture, and a tab portion at the base of said body portion that extends laterally outwardly from said body portion, the body of said shaving aid member being disposed in said aperture and an upper surface of said body portion protruding above said external skin engaging surface and structure in mechanical engagement with the base of said shaving aid member that firmly seats said tab portion against said internal seat surface of said support structure.

2. The razor of claim 1 wherein said one skin engaging surface has a plurality of said through apertures spaced along the transverse dimension of said skin engaging surface parallel to the shaving edge of said blade and said shaving aid member has a corresponding plurality of spaced body portions disposed in said apertures and protruding above said skin engaging surface.

3. The razor of claim 2 wherein said plural body portions are interconnected by tab portions.

4. The razor of claim 1 wherein the area of said upper surface of said shaving aid member is in the range of about 20–70 square millimeters, said upper surface protrudes at least about 0.1 millimeter above said one external skin engaging surface, and a portion of said razor blade is in mechanical engagement with the page of said shaving aid member and firmly seats said tab portion against said internal seat surface of said support structure.

5. The razor of claim 1 wherein said shaving aid member is a slice from an elongated extruded member.

6. The razor of claim 1 wherein said shaving aid member includes a tab portion along the length of said body portion.

7. The razor of claim 1 wherein said shaving aid member includes a tab portion at either end of said body portion.

8. The razor of claim 1 wherein said shaving aid member is composed a polymer blend of water soluble and insoluble polymer materials.

9. The razor of claim 8 wherein said water soluble polymer is present in said shaving aid member in an amount of at least about fifty percent by weight.

10. The razor of claim 9 wherein said polymer blend has a molecular weight in the range of one hundred thousand to six million.

11. The razor of claim 9 wherein said polymer blend includes a water soluble polymeric material selected from the class consisting of polyethylene oxide, polyvinyl pyrrolidone, polyacrylamides, hydroxypropyl cellulose, polyvinyl imidazonline and polyhydroxyethylmethacrylate and a water insoluble polymeric material selected from the class consisting of polyethylene, polypropylene, polystyrene and polyacetal.

12. The razor of claim 11 wherein said shaving aid member is a slice from an elongated extruded member.

13. The razor of claim 12 wherein said elongated extruded member is of shaped rod form.

14. The razor of claim 12 wherein said elongated extruded member is of convoluted sheet form 15. The razor of claim 12 wherein the area of said upper surface of said shaving aid member is in the range of 20–70 square millimeters, and said upper surface protrudes at least about 0.1 millimeter above said one external skin engaging surface.

16. The razor of claim 15 wherein said skin engaging surface has a plurality of said through apertures spaced along the transverse dimension of said skin engaging surface parallel to the shaving edge of said blade, said shaving aid member has a corresponding plurality of spaced body portions disposed in said apertures and said plural body portions are interconnected by tab portions and protrude above said skin engaging surface.

17. The razor of claim 16 wherein said water soluble polymer is polyethylene oxide and is present in said shaving aid member in an amount of about eighty percent by weight.

18. A razor having a razor blade and support structure that define external skin engaging surfaces in front of and to the rear of the cutting edge of said blade, and a shaving aid member of extrusion-oriented polymeric material that includes an effective amount of a water-leachable shaving aid composition permanently and substantially immovably affixed to said support structure with an upper surface that protrudes above one of said external skin engaging surfaces adjacent the cutting edge of said blade.

19. The razor of claim 18 wherein said shaving aid member is composed a polymer blend of water soluble and insoluble polymer materials, and said water soluble polymer is present in said shaving aid member in an amount of at least about fifty percent by weight.

20. The razor of claim 19 wherein said polymer blend includes a water soluble polymeric material selected from the class consisting of polyethylene oxide, polyvinyl pyrrolidone, polyacrylamides, hydroxypropyl cellulose, polyvinyl imidazonline and polyhydroxyethylmethacrylate and a water insoluble polymeric material selected from the class consisting of polyethylene, polypropylene, polystyrene and polyacetal.

21. The razor of claim 20 wherein said water soluble polymer is polyethylene oxide and is present in said shaving aid member in a quantity sufficient to provide effective shaving assistance for the entire expected life of said blade.

22. The razor of claim 21 wherein said one skin engaging surface has a plurality of said through apertures spaced along the transverse dimension of said skin engaging surface parallel to the shaving edge of said blade, said shaving aid member has a corresponding plurality of spaced body portions disposed in said apertures and said plural body portions are interconnected by tab portions, and a portion of said razor blade is in mechanical engagement with the base of said shaving aid member and firmly seats said tab portions against said internal seat surface of said support structure.

23. A razor having a razor blade and support structure that define external skin engaging surfaces in front of and to the rear of the cutting edge of said blade, said support structure having a plurality of through apertures in one of said skin engaging surface spaced along the transverse dimension of said one skin engaging surface parallel to the shaving edge of said blade, with a seat surface adjacent an internal edge of each said aperture, and a shaving aid member of extrusion-oriented polymeric material, said shaving aid member having a corresponding plurality of spaced body portions interconnected by tab portions, each body poriton of said shaving aid member being disposed in a corresponding aperture and an upper surface of each said body portion protruding above said external skin engaging surface, and a portion of said razor blade in mechanical engagement with the base of said shaving aid member that firmly seats said tab portions against said internal set surfaces of said support structure, said shaving aid member being composed a polymer blend of water soluble and insoluble polymer materials, said polymer blend including a water soluble polymeric material selected from the class consisting of polyethylene oxide, polyvinyl pyrrolidone, polyacrylamides, hydroxypropyl cellulose, polyvinyl imidazonline and polyhydroxyethylmethacrylate and a water insoluble polymeric material selected from the class consisting of polyethylene, polypropylene, polystyrene and polyacetal, and said water soluble polymer being present in said shaving aid member in an amount of at least about fifty percent by weight.

24. The razor of claim 23 wherein the area of said upper surface of said shaving aid member is in the range of 20–70 square millimeters, and said upper surface protrudes at least about 0.1 millimeter above said one external skin engaging surface.

25. The razor of claim 24 wherein said shaving aid member is a slice from an elongated extruded member.

26. The razor of claim 25 wherein said elongated extruded member is of shaped rod form and said shaving aid member includes a tab portion along the rear of said body portion.

27. The razor of claim 25 wherein said elongated extruded member is of convoluted sheet form and said shaving aid member includes a tab portion at either end of said body portion.

* * * * *